United States Patent [19]

Loire et al.

[11] Patent Number: 4,587,919

[45] Date of Patent: May 13, 1986

[54] SIMPLIFIED SINGLE DEVICE FOR MOORING AND LOADING-UNLOADING TANKER VESSELS FROM A SUBMARINE CONDUIT FOR FEEDING OR DISCHARGING A FLUID, AND METHOD OF INSTALLING SAID SUBMARINE CONDUIT AND SAID SIMPLIFIED MOORING DEVICE

[75] Inventors: René M. A. Loire, San Francisco, Calif.; Michel J. E. Pagezy, Paris, France

[73] Assignees: Renee M. A. Loire; Tramco S.A., both of France

[21] Appl. No.: 480,118

[22] Filed: Mar. 29, 1983

[30] Foreign Application Priority Data

Oct. 18, 1982 [FR] France ..... 82 17400

[51] Int. Cl.[4] ..... B63B 22/02

[52] U.S. Cl. ..... 114/230; 441/4

[58] Field of Search ..... 441/3-5; 114/230, 256, 257; 141/279, 387, 388

[56] References Cited

U.S. PATENT DOCUMENTS

| | | | |
|---|---|---|---|
| 3,236,267 | 2/1966 | Bily | 114/230 X |
| 3,455,270 | 7/1969 | Mascenik et al. | 114/230 |
| 3,700,014 | 10/1972 | Scales et al. | 441/5 X |
| 3,840,927 | 10/1974 | Reid, Jr. | 9/8 P |
| 3,979,785 | 9/1976 | Flory | 114/230 |
| 4,326,312 | 4/1982 | Tang | 441/5 |
| 4,387,660 | 6/1983 | Loire | 114/230 |

FOREIGN PATENT DOCUMENTS

| | | |
|---|---|---|
| 1242118 | 6/1967 | Fed. Rep. of Germany . |
| 1531026 | 7/1969 | Fed. Rep. of Germany . |
| 2134470 | 1/1973 | Fed. Rep. of Germany . |
| 2155190 | 5/1973 | France . |
| 2281267 | 3/1976 | France . |
| 2376022 | 7/1978 | France . |

OTHER PUBLICATIONS

"Demand for Offshore Loading Facilities Reaches an Industrial Record High", Offshore, vol. 37 No. 10, Sep. 1977, Tulsa, pp. 88-98.

*Primary Examiner*—Sherman D. Basinger
*Attorney, Agent, or Firm*—Steinberg & Raskin

[57] ABSTRACT

The invention relates to a simplified single mooring device for mooring and loading-unloading tanker vessels, comprising a submarine conduit for the supply or the discharge of a fluid, to which is connected at least one flexible pipe through a conduit end module, comprising a device for mooring the vessel and designed with a sufficient mass to withstand the pull from the vessel, and the flexible pipe being connected at least temporarily to conduits provided on the vessel through a hose end module including at least one rotary joint. The device allows the use of a buoy and of a submarine rotary joint to be avoided, while at the same time being of very simple design.

11 Claims, 18 Drawing Figures

FIG. 8
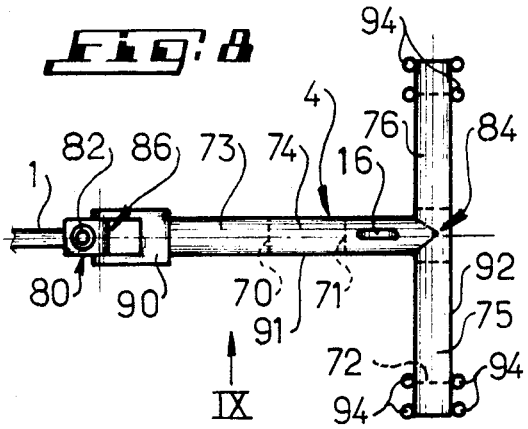
FIG. 10
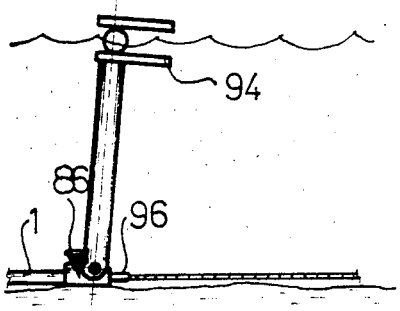
FIG. 9
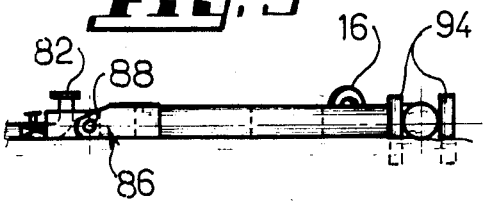
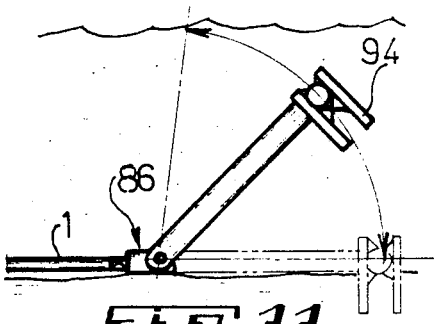
FIG. 11
FIG. 12
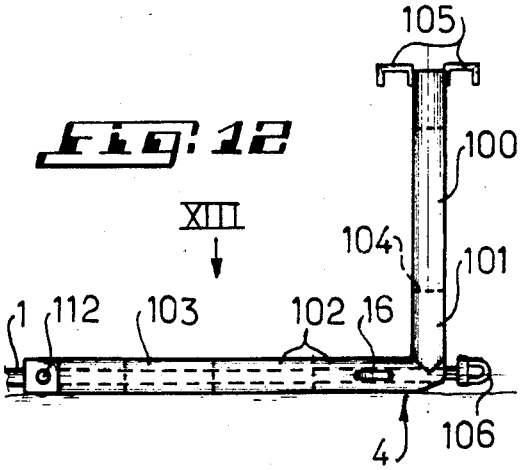
FIG. 14
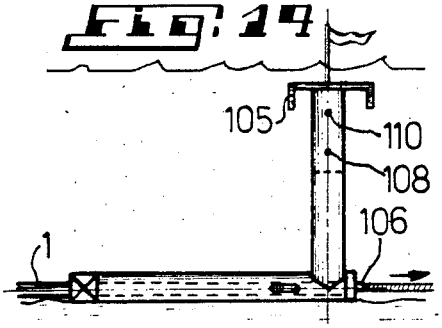
FIG. 13
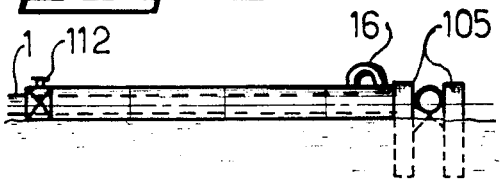
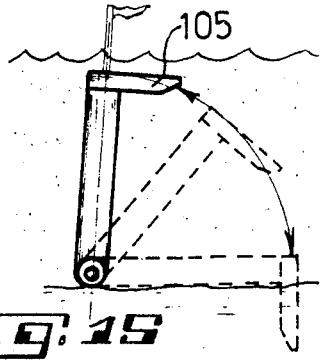
FIG. 15

SIMPLIFIED SINGLE DEVICE FOR MOORING AND LOADING-UNLOADING TANKER VESSELS FROM A SUBMARINE CONDUIT FOR FEEDING OR DISCHARGING A FLUID, AND METHOD OF INSTALLING SAID SUBMARINE CONDUIT AND SAID SIMPLIFIED MOORING DEVICE

BACKGROUND OF THE INVENTION

The present invention relates essentially to a simplified single mooring device for mooring and loading-unloading tanker vessels from a submarine conduit for feeding or discharging a fluid, as well as a method of installing said submarine conduit and said simplified mooring device.

There are presently known various off-shore mooring and loading-unloading systems (see Journal "OFF-SHORE", September 1977, pages 88–98).

For example, there is known a multiple-buoy mooring device, whereby the vessel is kept in almost stationary position by six anchors. One of its medial manifolds is connected to the submarine feed or discharge conduit through a flexible pipe resting on the sea bottom when not in use and picked from on-board the vessel at the beginning of each loading or unloading operation.

This device, however, suffers from the major drawback of being applicable only at sites where the vessel, once moored, lies permanently in the prevalent direction of the wind, of the current and of the heaviest wave. In case of variation of these elements, it may be subjected to transverse forces exceeding the capacity of its anchoring means.

There is also known a single-buoy multianchorage mooring device. In this case, the vessel rotates spontaneously around the buoy to place itself in the direction of the elements and thus reduce their action to a minimum.

At the same time it swivels a rotary joint located at the top of the buoy and which is connected to at least one floating flexible conduit ending at one of the manifolds.

Furthermore, the buoy is connected to the end of the submarine conduit by one or several hoses also lying underwater, as well as a conduit end module which is generally provided with remote-controlled valves operated from the surface.

Permanent mooring of the buoy is by means of from four to eight anchored chains, each of which must be capable of withstanding full pull from the tanker.

The device includes mechanical elements which are relatively complex and subject to wear and fatigue, such as the mono- or multi-passage rotary joint and the vessel mooring rotating head, which is a major drawback to such a device.

Also, in addition to the surface floating conduits, there are provided submarine hoses suspended from the buoy, which are strained by the movements of the latter due to swell and which subject the conduit end module to tractive forces which sometimes are considerable and of the same order of magnitude as those exerted by the vessel mooring hawser attached to the buoy.

There is also known a single-buoy single-anchored mooring device which comprises a single vertical tensioned chain which ensures multidirectional anchoring of the buoy to a gravity base or to a pile anchored base.

In this case, the rotary joint connected to the vessel by a flexible conduit partially floating at the surface is located not on the buoy but on the base. It is therefore a submarine rotary joint, and this is a major drawback to this device.

Indeed, such rotary joints with bearings, which are not actually designed and constructed for underwater operation, have a limited life, and their breakage, the time of occurrence of which cannot be forseen, will result in a pollution of the approaches, to say nothing of a shutdown of the terminal possibly for a long time for it would be necessary to await calm weather conditions before undertaking the repairs.

Another major drawback to this known buoy device lies in the fact that a collision of the vessel with the buoy, due either to a false manoeuvre or to a change of tide, may not only damage the body of the buoy but also lead to breakage of the anchoring chains, of the submarine hoses, and even cause a displacement of the Conduit End Module if the latter is not firmly anchored.

Lastly, in still another known device, the latter comprises a fixed mooring tower which, however, suffers from the drawback that it is relatively expensive and that the greater the depth of the sea bottom the higher its cost, and besides, such towers must also be provided with appropriate fenders for protection against drifting ships.

SUMMARY OF THE INVENTION

The purpose of the present invention, therefore, is to provide a simple solution for mooring and loading-unloading tanker vessels so as to lower the cost of supplies, to reduce their installation costs, to do away with any quick-wearing submarine rotary joints, to dispense also with the anchoring chains, whose life at sea is unforseeable and always limited, and above all, to completely eliminate the risk of vessel collision with the mooring-loading point.

Said solution, according to the present invention, is directed to a simplified mooring device for mooring and loading-unloading tanker vessels, of the type comprising a submarine conduit for the supply or the discharge of the fluid to be handled, to which is connected at least one flexible pipe resistant to tortional stresses through a conduit end module resting on the sea bottom, provided with an orifice for connection to the flexible pipe, the free end of the said flexible pipe being designed to be connectable to loading or unloading conduits or manifolds provided on the said vessel, characterized in that the said conduit end module comprises means for mooring the tanker vessel and is designed with a sufficient mass to withstand the pull from the vessel, and the flexible pipe is connected at least temporarily to the loading or unloading conduits or manifolds provided on the vessel through a hose end module including at least one rotary joint which is put in rotation during the rotations or drifts of the vessel under the action of external elements such as prevalent wind, current and wave.

According to a particularly advantageous form of embodiment of the device of the invention, the hose end module is fixed on the vessel, preferably at its bow, the flexible pipe being provided at its free end with a simple shutter or obturator and the hose end module including a rapid coupling associated with its rotary joint.

According to a particular form of embodiment, the hose end module is reduced to a rotary joint.

According to another particularly advantageous form of embodiment, the conduit end module is constituted essentially by a closed hollow structure including internal transverse fluid-tight partitions defining independent ballastable compartments.

According to various presently preferred forms of embodiment, the conduit end module may be substantially L-shaped or T-shaped.

According to a further particular characterizing feature, the conduit end module may comprise a rear portion fixed to the submarine conduit and provided with an orifice for communication with the submarine conduit and for connection with the flexible pipe, and a front portion hingedly connected to the rear portion so as to be rotatable with respect to the said rear portion either in a vertical plane passing through the axis of the submrine conduit or in a vertical plane perpendicular to the axis of the submarine conduit, or both.

The present invention also relates to a method of installing the submarine conduit and the simplified mooring device according to the above invention, characterized in that the non-ballasted conduit end module is mounted on land on the submarine conduit, the non-ballasted conduit end module thus having under the water its raised front portion, the submarine conduit and conduit end module assembly is hauled by the rear portion of the conduit end module provided with an at least temporary hauling means, and once the site is reached, the conduit end module is rapidly and instantaneously ballasted to cause a dynamic self-anchoring of the conduit end module.

Furthermore, according to an advantageous characterizing feature of this method, the conduit end module is also equipped on land with its flexible pipe and the said hose end module.

BRIEF DESCRIPTION OF THE DRAWINGS

Other purposes, characterizing features and advantages of the present invention will appear more clearly in light of the following explanatory description made with reference to the appended drawings wherein:

FIG. 8 is a plan view illustrating a particular form of embodiment of the conduit end device according to the invention;

FIG. 9 is a lateral view of the conduit end module of FIG. 8;

FIG. 10 diagrammatically illustrates the position of the conduit end module of FIG. 8 during the installation of the submarine conduit;

FIG. 11 illustrates the installation through dynamic self-anchoring of the conduit end module of FIGS. 8 to 10 according to the method of the present invention;

FIG. 12 is a plan view of another form of embodiment of the conduit end module forming the subject matter of the present invention;

FIG. 13 is a lateral view of the conduit end module of FIG. 12;

FIG. 14 is a diagrammatic partial view showing the position of the conduit end module of FIGS. 12 and 13 during the installation of the submarine conduit;

FIG. 15 diagrammatically illustrates the self-anchoring of the conduit end module of FIGS. 12 to 14 at the site according to the method of the present invention;

DETAILED DESCRIPTION OF THE PREFERRED EMBODIMENTS

Figure 1:
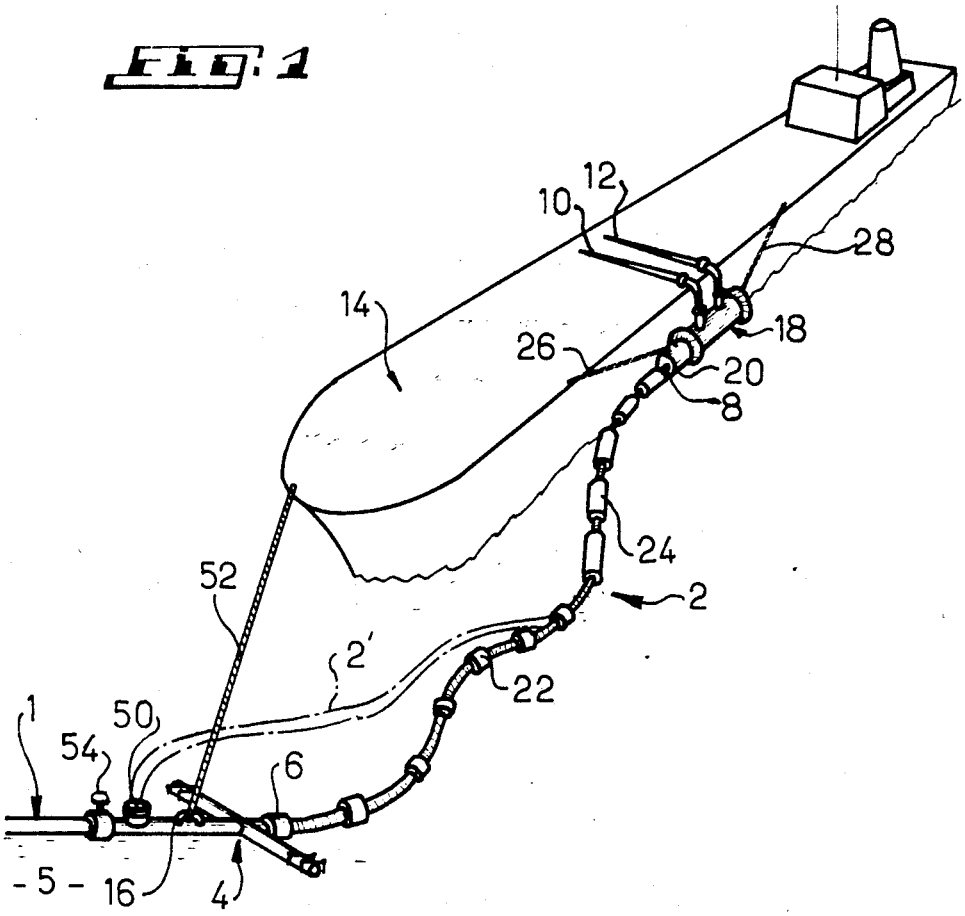
FIG. 1 is a general diagrammatic view of one, presently preferred form of embodiment of the simplified single mooring device for mooring and loading-unloading tanker vessels, according to the present invention.
Figure 2:
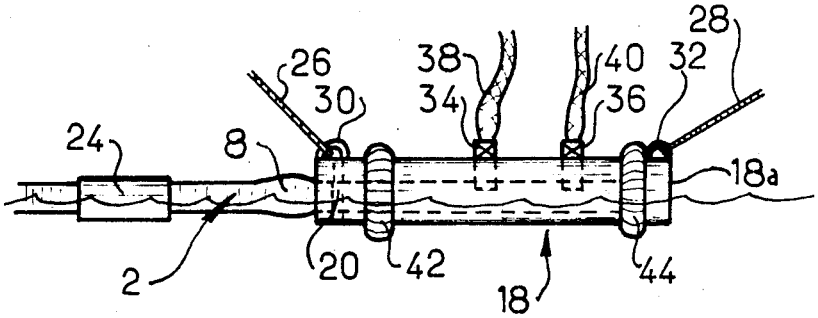
FIG. 2 is an enlarged detailed view of the hose end module shown in FIG. 1.

Referring to FIGS. 1 and 2, a first form of embodiment of a simplified mooring device according to the invention for mooring and loading-unloading a tanker vessel is of the type comprising a submarine conduit 1 for the supply or the discharge of the fluid to be handled, to which is connected at least one flexible pipe 2 resistant to torsional stresses through a conduit end module 4 resting on the sea bed 5, provided with an orifice 6 for connection to the flexible pipe 2; the free end 8 of the flexible pipe 2 being designed to be connectable to loading or unloading conduits or manifolds 10,12 provided on the tanker vessel 14.

According to the invention, this device is characterized in that the conduit end module 4 comprises mooring means 16 for mooring the tanker vessel 14 and the conduit end module 4 is designed with a sufficient mass to withstand the traction from the vessel 14. Furthermore, the flexible pipe 2 is connected at least temporarily to the loading or unloading conduits or manifolds 10,12 provided on the vessel 14 through a hose end module 18 including at least one rotary joint 20 which is put in rotation by the rotations or drifts of the vessel 14 under the action of the external elements such as prevalent wind, current and wave, owing to the quasi-undeformability in torsion of the flexible pipe 2.

It will be noted that the flexible pipe 2 is partially submerged and comprises in its immersed portion floats 22 designed to impart to it an almost zero apparent weight, whereas the emerged portion of the flexible pipe 2 is provided with floats 24 the buoyancy of which is markedly positive. The flexible pipe 2 must of course be of a length and have bending properties sufficient to allow deformation in harmonious curves with a radius compatible with the torsional rigidity of the flexible pipe 2 which, therefore, is generally made of reinforced rubber. Such deformation without folding nor squeezing is facilitated moreover by the near weightless state of the immersed portion of the hose 2.

It will be observed that, according to the form of embodiment illustrated in FIGS. 1 and 2, the hose end module 18 is shown moored laterally to the vessel 14 by means of howsers 26,28, so that the hose end module 18 is provided with means 30,32 for attaching the howsers 26,28, such as rings.

It will also be observed, as seen clearly in FIG. 2, that the hose end module 18 has a rotary joint 20 which is incorporated in its mass. Thus, the free end 8 of the flexible pipe 2 is connected to a portion of the rotary joint 20 whereas the hose end module 18 is connected to the other portion of the rotary joint 20 or forms an integral part of this other portion, i.e., in fact, the flexible pipe 2 is mounted rotatably with respect to the hose end module 18. In the form of embodiment illustrated in FIG. 2, the hose end module 18 is essentially constituted by a hollow structure which may be of metal and closed at its free end 18*a* opposite to the side where the rotary joint 20 is located. The hose end module 18 may include integrated float compartments to impart to it positive buoyancy.

Furthermore, according to the example illustrated in FIG. 2, the hose end module may serve as a manifold and be equipped with one or several shut-off valves 34,36 from which starts an associated affluent flexible pipe 38,40 which generally is smaller in diameter than the main flexible pipe 2 and opening individually into the conduits 10,12 of the vessel 14.

Furthermore, in this case, the hose end module 18 is advantageously provided with resilient fenders 42,44 protecting it against damage from its contacts with the vessel 14.

It will be observed that, in certain simple cases, particularly when it is not necessary to sub-divide the main flexible pipe 2, the hose end module may be reduced to a rotary joint 20 which it is then possible to raise out of the water for direct connection with one of the conduits 10,12 of the vessel 14.

Furthermore, when several liquid products have to be loaded or unloaded, there may be provided more than one submarine conduit 1. Likewise, use may be made of more than one connection 6, more than one flexible pipe 2 and, therefore, more than one rotary joint 20 or a multi-passage coaxial rotary joint.

Furthermore, the orifice 6 for connecting the conduit end module 4 to the flexible pipe 2 is not imperatively arranged in prolongation of the submarine conduit 1 and may be located at the rear of the conduit end module 4 and extend in a vertical plane, as shown at 50, in which case the flexible pipe 2 is in the position shown in phantom lines 2'. Of course, there may also be provided a combination of these two orifices with two hoses starting separately and then meeting into a common hose.

To avoid having to moor the vessel 14 on the mooring means 16 located on the sea bed, a hawser 52 has one of its ends permanently attached to the mooring means 16 and is designed so as to allow its free end of positive buoyancy to end with a marking float facilitating the picking up of the hawser 52 as in the case of the hose end module 18.

Of course the conduit end module 4 may also serve as a manifold and comprise one or several valves such as 54.

Figure 3:
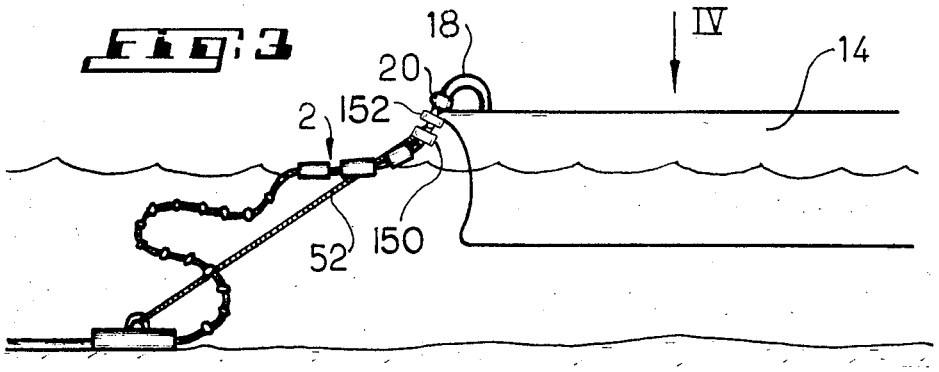
FIG. 3 is an elevational view of a particular form of embodiment wherein the hose end module is fixed on the vessel.
Figure 4:
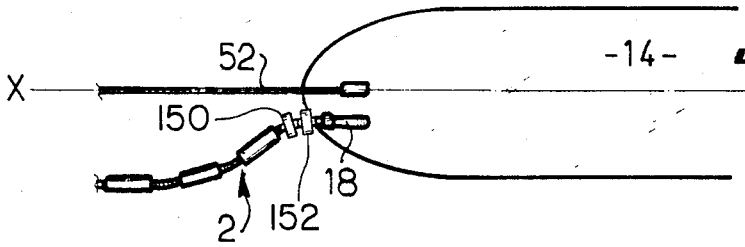
FIG. 4 is a view in the direction of arrow IV of FIG. 3.

Furthermore, the hose end module 18 may, in an advantageous form of embodiment, be fixed on the vessel 14, preferably at its bow, as shown in FIGS. 3 and 4. In this case, the flexible pipe 2 is provided at its free end with a simple shutter or obturator 50 and the hose end module 18 comprises a rapid coupling 152 associated with its rotary joint 20.

It will be observed that, in this case, both the hawser 52 and the flexible pipe 2 end preferably at the bow of the vessel 14 are at points near one another but with the hose end module 18 slightly apart from the axis X—X of the vessel 14 which is necessarily reserved for the fixing of the hawser 52. This arrangement is particularly advantageous in the case of rough open sea, over a submarine oil field served by specially assigned vessels.

As a further result of these arrangements, the flexible pipe is advantageously shorter than in the more frequent case of a connection to the standard medial manifold of the vessel, as shown in FIGS. 1 and 2.

Furthermore, the hawsers 52, which generally are made of nylon or polypropylene, are subject to fatigue caused by variations in tension and finally break if they are not replaced in time. Thus, the hawser 52 ending directly at the conduit end module 4 requires to be connected to the mooring means 16, or to be disconnected therefrom, by a diver.

Figure 5:
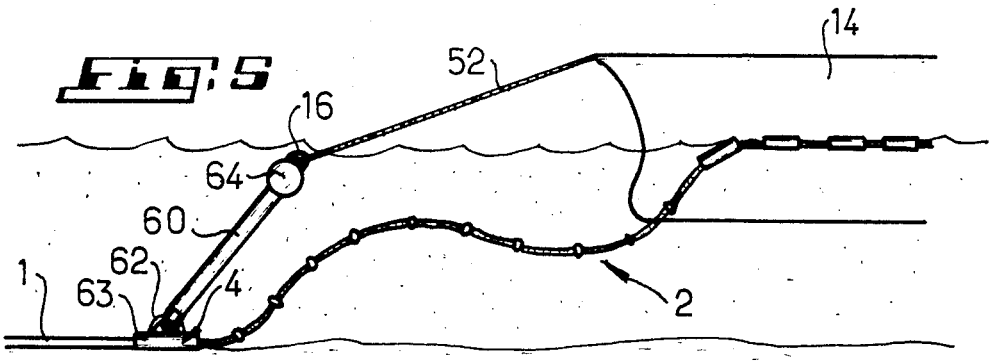
FIG. 5 illustrates another form of embodiment of of the device according to the present invention allowing easy mooring of the vessel.
Figure 6:
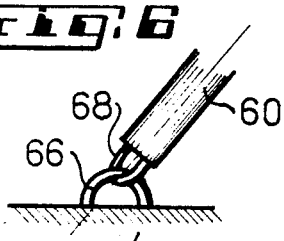
FIGS. 6 and 7 illustrate variants of embodiment of the articulation between the mooring rod and the conduit end module.
Figure 7:
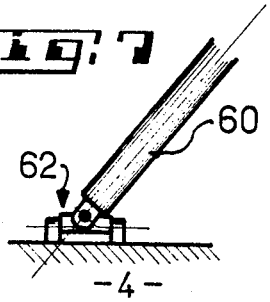

This drawback may be obviated by modifying the conduit end module as shown in FIGS. 5 to 7, so that it comprises a rod or bar 60 articulated at 62 at its bottom on the body 63 of the conduit end module 4 resting on the sea bed. The rod 60 is advantageously provided with a float 64 so that, when no vessel is moored to the conduit end module 4, its free end is flush with or projects from the surface of the water so as to be easily locatable and accessible, the said free end being provided with the aforesaid mooring means 16 for the hawser 52 which is advantageously designed to be buoyant and with a locating buoy to facilitate its picking up.

In FIG. 6 is illustrated a form of embodiment of the articulation 62 between the rod 60 and the conduit end module 4. In the case considered, this articulation is designed in the form of two interlocked rings 66,68.

A preferred form of embodiment is the one illustrated in FIG. 7, wherein the rod 60 is articulated to the hose end module 4 by an articulation consisting of a mechanical, universal joint 62, which is advantageous on account of its small play.

Referring to FIGS. 8 to 11, there is illustrated one of the presently preferred forms of embodiment of the conduit end module according to the invention, which, in this case, is substantially T-shaped, with the leg of the T preferably extending in prolongation of the submarine conduit 1.

The conduit end module, either T-shaped or not, is advantageously constituted essentially by a closed hollow structure including internal fluid-tight transverse partitions such as 70,71,72 defining independent ballastable compartments such as 73,74,75,76.

According to this form of embodiment as illustrated the conduit end module 4 comprises a rear portion 80 fixed to the submarine conduit 1 and provided with an orifice 82 for communication with the submarine conduit 1 and for connection to the flexible pipe 2, and a second front portion 84 articulated at 86 to the rear portion 80 so as to be rotatable with respect to the rear portion 80 either in a vertical plane passing through the axis of the submarine conduit 1 or in a vertical plane perpendicular to the axis of the submarine conduit 1, or both.

In the example illustrated, it will be observed that this articulation is formed of a shaft 88 which, as clearly seen in FIG. 9, is perpendicular to the axis of the submarine conduit 1 and passes through the rear portion 80 on the ends of which is secured a fork 90 integral with the leg 91 of the T.

This arrangement allows the front portion 84 to rotate, in a vertical plane passing through the axis of the submarine conduit 1, with respect to the rear portion 80 of the conduit end module 4.

According to this form of embodiment, the horizontal bar 92 of the T-shaped member is advantageously provided on either side with teeth or spades 94 for anchoring the conduit end module 4 on the sea bed, the said teeth or spades 94 being preferably constituted by flat panels or tubes open at their lower end.

It is thus easily understood that this structure of the conduit end module 4, when not ballasted, allows the aforesaid method of the invention to be carried out for installing the assembly constituted by the submarine conduit 1 and the device according to the invention, as shown in FIGS. 10 and 11.

It will be observed that, in this case, when the front portion of the conduit end module 4 is not ballasted, the latter is normally buoyant and is therefore raised, as appears in FIG. 10. The submarine conduit 1 can thus be drawn by using at least temporary hauling means 96 at the rear portion 80 of the conduit end module 4.

When the site is reached, it is sufficient to perform a rapid or instantaneous ballasting of the front portion of the T-shaped conduit end module to thus obtain a dynamic self-anchoring of the conduit end module owing to the presence of the teeth or spades 94 on the bar of the T-shaped member and as can be quite clearly understood from the representation of FIG. 11 by the presence of arrows and of the anchored position shown in phantom lines.

In another form of embodiment of the conduit end module, the latter is L-shaped as shown in FIGS. 12 to 15.

This form of embodiment allows a similar installation as in the case of the T-shaped embodiment of FIGS. 8 to 11. Thus, the L-shaped conduit end module also comprises ballastable compartments 100,101,102,103 which are ballasted rapidly or instantaneously at the site, as shown in FIG. 15. In this case, the bar 104 of the L-shaped conduit end module 4 is provided at its free end with teeth or spades 105 as in the case of the T-shaped conduit end module of FIGS. 8 to 11 to thus ensure a dynamic self-anchoring of the conduit end module according to the method of the present invention.

It will be observed, however, that in this case the conduit end module is provided with hauling means 106 such as a ring in prolongation of the bar of the L-shaped member coaxial with the submarine conduit 1.

Whether the end module is L-shaped or T-shaped, rapid or instantaneous ballasting can be obtained by providing pyrotechnical valves designated by the reference numerals 108,110 in FIG. 14, controlled by wires or ultrasound. Another way of causing such rapid or instantaneous ballasting would be by demolishing one or several partitions in contact with the sea, thus resulting in an instantaneous flooding of the compartments to be ballasted.

It will be observed that some of the compartments of the conduit end module can be filled with permanent ballast of concrete or other heavy material contributing to the stability in operation of the conduit end module when subjected to the mooring stresses, whereas other compartments can be ballastable with water or heavy mud. These latter compartments are the ones that are kept empty during the drawing of the submarine conduit 1 and cause a portion of the conduit end module to float in a more or less vertical plane, such as the arm 104 of the L-shaped member or the front portion 84 of the T-shaped member, thus contributing in easing the strain on the conduit end module in its function as a drawing head for the submarine conduit 1.

In the case of the L-shaped form of embodiment of the conduit end module, the arm 104 thereof, during the ballasting of the non-ballasted compartments located in the arm 104, causes a rotation around the conduit 1.

In this case, the flexible pipe is preferably connected to a connecting orifice 112 located at the rear of the conduit end module in a vertical plane, as seen clearly in FIG. 12.

The present invention therefore allows a dynamic self-anchoring to be obtained in a particularly simple manner while at the same time facilitating the installation of the submarine conduit 1 and the simplified mooring device according to the invention.

Figure 16:
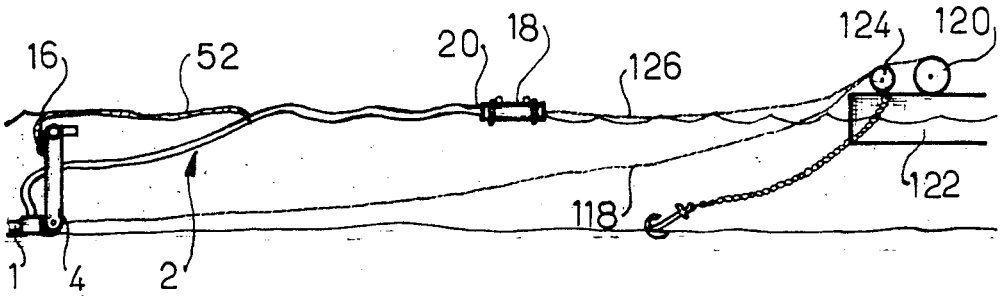
FIGS. 16 and 17 are an elevational view and a plan view, respectively, showing the arrangement of the various elements of the simplified mooring device according to the present invention during the installation of the submarine conduit.
Figure 17:
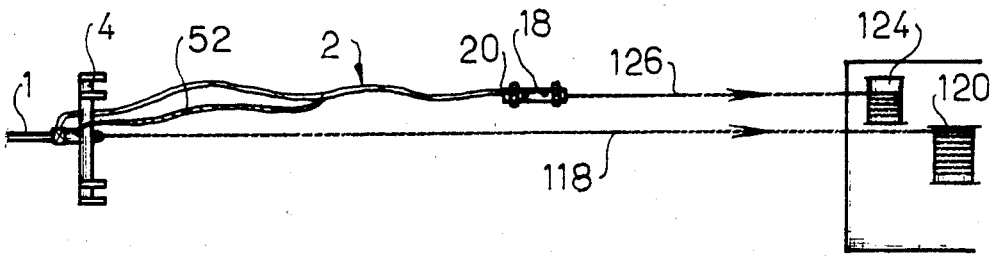

According to an advantageous characterizing feature of this method, as mentioned previously, the conduit end module may also be provided on land with all the necessary accessories to obtain the complete single mooring and fluid loading-unloading device according to the invention. FIGS. 16 and 17 illustrate this preferred feature of the method of installation.

It will thus be observed, referring to FIGS. 16 and 17, that the conduit 1 has been provided on land with a conduit end module (shown for example in T-shape) 4, itself provided on land with the flexible pipe 2 and with the hose end module 18 provided with the rotary joint 20, the conduit end module 4 being provided with the hawser 52 attached to the mooring means 16. There is shown in FIG. 16 the towing cable 118 connected to a winch 120 of a towing barge 122, an auxiliary winch 124 being provided to pull an auxiliary line 126 for towing the hose end module 18.

FIG. 17 is a plan view of this assembly of means.

Figure 18:
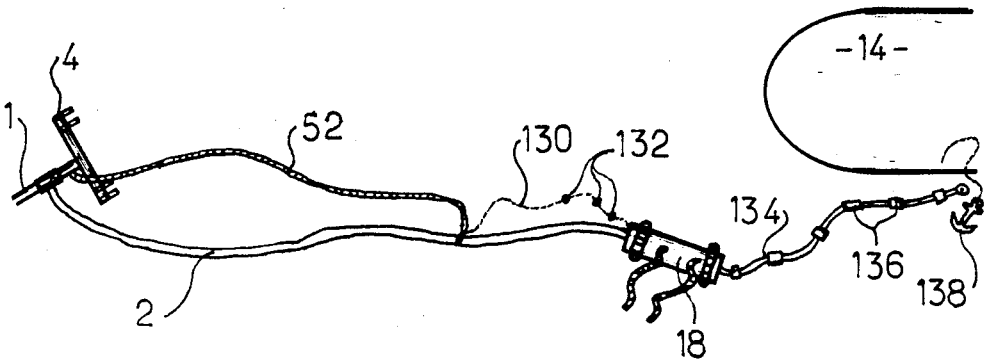
FIG. 18 is a diagrammatic view illustrating the berthing of a tanker vessel at the site.

Referring to FIG. 18, there is diagrammatically illustrated the procedure of berthing the vessel at the site.

It is seen that, at the site, the floating hawser 52 may be provided with a hawser heaving-line 130 with a floating marker 132. Likewise, the floating hose end module 18 may also be provided with a hawser heaving-line 134 also provided with floating markers 136 facilitating the picking up, e.g. by means of a grapnel 138, from the tanker vessel 14. It will be observed that the berthing is particularly simple, since no use is made of a mooring buoy which the vessel 14 might run into, whereas with conventional buoy devices the flexible conduits and the hoses tend to wind around the buoy owing to changes in the direction of current or wind, thus causing them damages as a result of friction and requiring the presence of a servicing motor boat at the terminal in order to disentangle these lines before use. This, in the known devices, often requires that they be anchored in a fixed direction by means of permanent moorings which the servicing motor boat must raise to the surface when a vessel arrives, whereafter the motor boat arranges the hawser and the floating conduit in the direction of the vessel.

With the device of the present invention, this precaution, i.e. the temporary anchoring of the floating lines, is useless since there is no longer any anchored floating buoy and the vessel berthing movements are therefore considerably simplified and are facilitated by the presence of marking floats and of the hawser heaving line, as shown in FIG. 8, even though these last features are not absolutely necessary. Likewise, the device of the invention allows a servicing motor boat to be dispensed with, for the marking floats provided on the heaving-lines leading to the hawser and to the floating hose can be easily picked up from the vessel by means of the grapnel, as can be clearly understood from FIG. 18.

Furthermore, the device of the invention offers the considerable advantage of not using any submarine rotary joint inaccessible from the surface for supervision and maintenance and/or directly or indirectly subjected to the mooring pulls. Likewise, the flexible conduit runs directly and quite naturally from the submarine conduit 1 to the vessel without necessarily passing through a buoy.

It will also be understood that the simplified single mooring device for mooring and for fluid loading or unloading according to the invention allows substantially reducing the installation costs, and the increase of its cost with the increase in water depth is markedly smaller than in the case of the prior buoy devices.

Furthermore, the invention of course comprises all the means constituting technical equivalents to the means described as well as their combinations. It will be observed, in this connection, that the various forms of embodiment described and illustrated, notably for the conduit end module and the hose end module, can be combined together.

Also, the conduit end module 4 may be shaped otherwise, in particular I-shaped.

What is claimed is:

1. A simplified unitary device for mooring and loading/unloading a tanker vessel, comprising a submarine conduit for the supply or discharge of a fluid, at least one flexible pipe resistant to torsional stress, said at least one flexible pipe having a first end and a second free end, a conduit end module resting upon a sea floor and provided with orifice means for connection with said first end of said flexible pipe, through which said flexible pipe communicates with said submarine conduit, said orifice means being fixed and non-pivotable with respect to said conduit end module and said first end of said flexible pipe being non-rotatably and fixedly connected to said orifice means, a hose end module including at least one rotary joint, said hose end module being at least temporarily connected with loading or unloading conduits provided on the vessel, said free end of said flexible pipe being at least temporarily connected with a part of said at least one rotary joint, through which said flexible pipe is at least temporarily communicated with the loading or unloading conduits provided on the vessel, said rotary joint being substantially coaxial with a portion of said flexible pipe proximate to said free end thereof, and said conduit end module comprises mooring means for mooring the tanker vessel and having sufficient mass to withstand any pull from the vessel, whereby when the vessel rotates or drifts with respect to said conduit end module under the action of external elements such as wind, current and waves, said flexible pipe is prevented from rotating due to said orifice means to which said first end of said flexible pipe is connected being fixed and non-pivotal with respect to said conduit end module whereby torsion is built up in said flexible pipe which is finally released by said rotary joint.

2. The device of claim 1, wherein said hose end module is affixed to the vessel, and additionally comprising a simple shutter provided at the free end of said flexible pipe, and a rapid coupling associated with said at least one rotary joint of said hose end module.

3. The device of claim 1, wherein said conduit end module consists essentially of a closed hollow structure comprising internal transverse, fluid-type partitions defining independent ballastable compartments.

4. The device of claim 1, wherein said conduit end module is substantially L-shaped.

5. The device of claim 1, wherein said conduit end module is substantially T-shaped, with a leg portion of said substantially T-shaped conduit end module engaged with said submarine conduit.

6. The device of claim 5, wherein a top, transverse portion of said substantially T-shaped conduit end module is in the shape of a bar, and additionally comprising anchoring means for anchoring said conduit end module to the sea floor, said anchoring means being disposed on either side of said top portion of said substantially T-shaped module from said leg portion thereof.

7. The device of claim 1, wherein said conduit end module comprises a rear part engaged with said submarine conduit and provided with an orifice for communication with said submarine conduit and for connection to said flexible pipe, and a front part articulated with said rear part, so as to be rotatable with respect to said rear part thereof.

8. The device of claim 1, wherein said conduit end module comprises a body portion resting upon the sea floor, a rod portion having a bottom end and a free end, said bottom end thereof articulated to said body portion of said conduit end module, and said free end thereof being provided with said mooring means, said mooring means including a buoyant hawser, and a float provided on said rod portion so that said free end thereof is at least flush with or above the surface of the water when no vessel is moored to said conduit end module.

9. The device of claim 1, wherein said hose end module is affixed to said flexible pipe by said rotary joint, and comprises internally-disposed floats whereby said hose end module is buoyant.

10. The device of claim 1, wherein said hose end module constitutes manifold means, and is provided with at least one shut-off valve, and an affluent flexible pipe extending from said valve.

11. The device of claim 1, wherein said hose end module includes means for mooring the same.

* * * * *

UNITED STATES PATENT AND TRADEMARK OFFICE

CERTIFICATE OF CORRECTION

PATENT NO. : 4,587,919

DATED : May 13, 1986

INVENTOR(S) : Rene M. A. Loire, et al.

It is certified that error appears in the above—identified patent and that said Letters Patent is hereby corrected as shown below: On the title page:

(73) assignees: RENE M. A. LOIRE; Tramco S.A., both of France

Signed and Sealed this

Fourteenth Day of August, 1990

*Attest:*

HARRY F. MANBECK, JR.

*Attesting Officer*

*Commissioner of Patents and Trademarks*